US009180719B2

(12) United States Patent
Nguyen

(10) Patent No.: US 9,180,719 B2
(45) Date of Patent: Nov. 10, 2015

(54) SUBSTRATE FOR LITHOGRAPHIC PRINTING PLATE

(75) Inventor: My T. Nguyen, Kirkland (CA)

(73) Assignee: MYLAN GROUP, Tra Vinh (VN)

( * ) Notice: Subject to any disclaimer, the term of this patent is extended or adjusted under 35 U.S.C. 154(b) by 1195 days.

(21) Appl. No.: 13/090,389

(22) Filed: Apr. 20, 2011

(65) Prior Publication Data

US 2011/0277653 A1 Nov. 17, 2011

Related U.S. Application Data

(60) Provisional application No. 61/326,005, filed on Apr. 20, 2010, provisional application No. 61/329,293, filed on Apr. 29, 2010.

(51) Int. Cl.

| | |
|---|---|
| ***B41N 1/00*** | (2006.01) |
| ***B41N 1/14*** | (2006.01) |
| ***B41N 1/08*** | (2006.01) |
| *B41C 1/10* | (2006.01) |

(52) U.S. Cl.

CPC .. *B41N 1/14* (2013.01); *B41N 1/08* (2013.01); *B41N 1/083* (2013.01); *B41N 1/086* (2013.01); *B41C 1/1016* (2013.01)

(58) Field of Classification Search

CPC ..... B41N 1/086
USPC ..... 101/453, 454, 457, 460, 462, 463.1, 101/395, 379, 401
See application file for complete search history.

(56) References Cited

U.S. PATENT DOCUMENTS

| | | | | |
|---|---|---|---|---|
| 4,092,925 | A | 6/1978 | Fromson | |
| 5,188,032 | A | 2/1993 | Lewis et al. | |
| 5,324,812 | A | 6/1994 | Speranza et al. | |
| 5,891,598 | A * | 4/1999 | Miyabe et al. | 428/332 |
| 5,988,066 | A * | 11/1999 | Robinson et al. | 101/457 |
| 6,103,809 | A | 8/2000 | Ahmed et al. | |
| 6,105,501 | A | 8/2000 | Phillips et al. | |
| 6,124,425 | A | 9/2000 | Nguyen | |
| 6,143,470 | A | 11/2000 | Nguyen et al. | |
| 6,177,182 | B1 | 1/2001 | Nguyen | |

(Continued)

FOREIGN PATENT DOCUMENTS

| | | | |
|---|---|---|---|
| CN | 86103201 | A | 11/1987 |
| CN | 2665762 | Y | 12/2004 |

(Continued)

OTHER PUBLICATIONS

Search Report PCT/CA2011/050209 mailed on Jun. 21, 2011.

*Primary Examiner* — Blake A Tankersley
*Assistant Examiner* — Quang X Nguyen
(74) *Attorney, Agent, or Firm* — Lathrop & Gage LLP; Brian C. Trinque; Anthony J. Janiuk

(57) ABSTRACT

There is provided a lithographic printing plate substrate comprising (a) a base layer, (b) a layer of a first adhesive covering one side of the base layer except for at least two opposite edges thereof, and (c) an aluminum layer laminated onto the layer of first adhesive and said opposite edges of the base layer, the aluminum layer thereby being sealed with the base layer at said opposite edges of the base layer. There is also provided a method of manufacture thereof as well as a method of processing in view of recycling. Finally, there is provided a lithographic printing plate comprising the above substrate.

23 Claims, 4 Drawing Sheets

(56) References Cited

U.S. PATENT DOCUMENTS

| | | | | |
|---|---|---|---|---|
| 6,261,740 | B1 | 7/2001 | Nguyen et al. | |
| 6,578,485 | B2 | 6/2003 | Friedman | |
| 6,899,029 | B2 * | 5/2005 | Invernizzi | 101/376 |
| 7,214,468 | B2 | 5/2007 | Takahashi et al. | |
| 7,473,515 | B2 | 1/2009 | Nguyen et al. | |
| 2003/0035923 | A1 | 2/2003 | Friedman | |
| 2004/0154488 | A1 | 8/2004 | Tomita et al. | |
| 2007/0269739 | A1 | 11/2007 | Nguyen et al. | |
| 2008/0171286 | A1 | 7/2008 | Nguyen et al. | |
| 2008/0305427 | A1 * | 12/2008 | Sanada et al. | 430/270.1 |
| 2009/0035694 | A1 | 2/2009 | Nguyen et al. | |
| 2009/0286909 | A1 | 11/2009 | Shibutani et al. | |
| 2010/0035183 | A1 | 2/2010 | Nguyen et al. | |
| 2010/0062370 | A1 | 3/2010 | Nguyen et al. | |

FOREIGN PATENT DOCUMENTS

| | | | |
|---|---|---|---|
| CN | 101195312 | A | 6/2008 |
| DE | 413844 | C1 | 5/1925 |
| EP | 0575625 | A1 | 12/1992 |
| EP | 1400851 | A2 | 3/2004 |
| JP | 10-272858 | | 10/1998 |
| TW | 574158 | B | 2/2004 |
| WO | 2008150441 | A1 | 12/2008 |

* cited by examiner

SUBSTRATE FOR LITHOGRAPHIC PRINTING PLATE

CROSS REFERENCE TO RELATED APPLICATIONS

This application claims benefit, under 35 U.S.C. §119(e), of U.S. provisional applications Ser. No. U.S. 61/326,005 and U.S. 61/329,293, filed on Apr. 20, 2010 and Apr. 29, 2010, respectively. All documents above are incorporated herein in their entirety by reference.

FIELD OF THE INVENTION

The present invention relates to substrates for lithographic printing plates. More specifically, the present invention is concerned with such a substrate, with a printing plate comprising this substrate and with methods of manufacturing thereof and method of processing in view of recycling thereof.

BACKGROUND OF THE INVENTION

In lithographic printing, a printing plate is mounted on the cylinder of a printing press (typically using clamps on two opposite sides of the printing plate). The printing plate carries a lithographic image on its surface and a printed copy is obtained by applying ink to the image and then transferring the ink from the printing plate onto a receiver material, which is typically a sheet of paper. Generally, the ink is first transferred to an intermediate blanket, which in turn transfers the ink to the surface of the receiver material (offset printing).

In conventional, so-called "wet" lithographic printing, ink as well as an aqueous fountain solution (also called dampening liquid) are supplied to the lithographic image which consists of oleophilic (or hydrophobic, i.e. ink-accepting, water-repelling) areas as well as hydrophilic (or oleophobic, i.e. water-accepting, ink-repelling) areas. When the surface of the printing plate is moistened with water and ink is applied, the hydrophilic regions retain water and repel ink, and the ink-receptive regions accept ink and repel water. During printing, the ink is transferred to the surface of the receiver material upon which the image is to be reproduced.

Lithographic printing plates typically comprise an imageable layer (also called imaging layer or imaging coating) applied over the hydrophilic surface of a substrate, typically aluminum. The imageable layer includes one or more radiation-sensitive components, often dispersed in a suitable binder.

To produce the lithographic image on the printing plate, the printing plate is imaged by targeted radiation. This can be carried out in different ways. In direct digital imaging (computer-to-plate), printing plates can be imaged with infrared or UV lasers or light sources. Such a laser or light source can be digitally controlled via a computer; i.e. the laser can be turned on or off so that imagewise exposure of the precursor can be effected via stored digitized information in the computer. Therefore, the imageable layers of printing plates, which are to be imagewise exposed by means of such image-setters, need to be sensitive to radiation in the near-infrared region or UV of the spectrum.

The imaging device will thus etch the image on the printing plate by eliciting a localized transformation of the imageable layer. Indeed, in such systems, the imageable layer typically contains a dye or pigment that absorbs the incident radiation and the absorbed energy initiates the reaction producing the image. Exposure to the imaging radiation triggers a physical or chemical process in the imageable layer so that the imaged areas become different from the non-imaged areas and development will produce an image on the printing plate. The change in the imageable layer can be a change of hydrophilicity/oleophilicity, solubility, hardness, etc.

Following exposure, either the exposed regions or the unexposed regions of the imageable layer are removed by a suitable developer, revealing the underlying hydrophilic surface of the substrate. Developers are typically aqueous alkaline solutions, which may also contain organic solvents.

Alternatively, "on-press developable" or "processless" lithographic printing plate can be directly mounted on a press after imaging, and are developed through contact with ink and/or fountain solution during initial press operation. In other words, either the exposed regions or the unexposed regions of the imageable layer are removed by the ink and/or fountain solution, not by a developer. More specifically, a so-called on-press development system is one in which an exposed printing plate is fixed on the plate cylinder of a printing press, and a fountain solution and ink are fed thereto while revolving the cylinder to remove the undesired areas. This technique allows an imaged, but un-developed printing plate (also called a printing plate precursor) to be mounted as is on a press and be made into a developed printing plate on an ordinary printing line.

If the exposed regions are removed, the precursor is positive-working. Conversely, if the unexposed regions are removed, the precursor is negative-working. In each instance, the regions of the imageable layer (i.e., the image areas) that remain are ink-receptive, and the regions of the hydrophilic surface revealed by the developing process accept water and aqueous solutions, typically a fountain solution, and do not accept ink.

The image on lithographic printing plate can also be produced using laser or inkjet printers.

For a long time, aluminum has been the substrate of choice for manufacturing of lithographic offset printing plates. This is due to its flexibility, durability on press and its recyclability (as scrap metal) after usage. The ever higher aluminum and energy costs have now however intensified a need in the industry for replacement substrates, which would reduce the cost of lithographic printing plate production.

When aluminum is used as a substrate, it is typically treated to produce a generally rough and hydrophilic aluminum oxide layer at its surface. This improves adhesion of the imaging layer and other layers that may constitute the printing plate. This also provides the hydrophilic (or oleophobic, i.e. water-accepting, ink-repelling) areas on the developed printing plate.

Various others substrates are also known, including substrates made of aluminum foil laminated on a plastic or paper base layer. However, these can de-laminate upon use on press and are thus generally useful only for short run printing. More importantly, these substrates are not readily recyclable, which prevented their wide acceptance in the industry.

Also, polymeric substrates on which an imaging layer is deposited are known in the art. Again, these are generally useful only for short run printing. In addition, such substrates have a tendency to stretch upon use, which causes distortion of the printed image. However, these substrates are generally recyclable.

Printing plates generally have a tendency to stick to one another when stacked (for storage or use). To prevent this undesirable phenomenon, sheets of interleaving paper is typically placed in-between the plates. This increases the handling cost as the interleaving paper has to be removed for the plates to be loaded on a printing press. Similarly, it is noted that it is very difficult to cut a stack of printing plates to size without using interleaving paper.

The present description refers to a number of documents, the content of which are herein incorporated by reference in their entirety.

SUMMARY OF THE INVENTION

More specifically, in accordance with the present invention, there is provided:

1. A lithographic printing plate substrate comprising:
   a base layer,
   a layer of a first adhesive covering one side of the base layer except for at least two opposite edges thereof, and
   an aluminum layer laminated onto the layer of first adhesive and said opposite edges of the base layer, the aluminum layer thereby being sealed with the base layer at said opposite edges of the base layer.
2. The substrate of claim 1, wherein strips of a second adhesive cover said opposite edges of the base layer and wherein the aluminum layer is laminated onto the layer of first adhesive and said strips of second adhesive.
3. The substrate of claim 1 or 2, wherein the first adhesive is soluble or dispersible in a processing liquid, such as water or a water-alcohol mixture.
4. The substrate of any one of claims 1 to 3, wherein the first adhesive is a thermoplastic resin.
5. The substrate of any one of claims 1 to 4, wherein the first adhesive is a linear polyvinyl alcohol, a branched polyvinyl alcohol, polyethylene oxide, a polyamide, a water-soluble polyester, an acrylic acid copolymer, a methacrylic acid copolymer, an urethane polymer, an urea polymer, an amide polymer, an ester polymer or copolymers or a mixture thereof.
6. The substrate of any one of claims 2 to 5, wherein the second adhesive is insoluble and non-dispersible in water and fountain solutions.
7. The substrate of claim 6, wherein the second adhesive is solvent-based.
8. The substrate of claim 6 or 7, wherein the second adhesive is an urethane adhesive.
9. The substrate of any one of claims 2 to 8, wherein the base layer is a cellulose-based layer, such as paper.
10. The substrate of any one of claims 1 to 8, wherein the base layer is a non-woven fabric layer.
11. The substrate of any one of claims 1 to 8, wherein the base layer is a plastic layer.
12. The substrate of claim 11, wherein the plastic layer is a solid plastic layer.
13. The substrate of claim 11, wherein the plastic layer is a plastic foam layer.
14. The substrate of any one of claims 11 to 13, wherein the base layer comprises a thermoplastic resin.
15. The substrate of claim 14, wherein the thermoplastic resin is polystyrene, polyethylene, polypropylene, polyester, polyamide, polyvinyl chloride, polyetheretherketone, polyimide, polyvinylacetate, polyalkylacrylate, polyalkylmethacrylate, polylactide, polybutahydroburate, polysuccinamate, a cellulosic polymer, copolymers thereof, or a mixture thereof.
16. The substrate of any one of claims 11 to 15, wherein the base layer comprises a filler.
17. The substrate of claim 16, wherein the filler is an inorganic filler.
18. The substrate of claim 17, wherein the inorganic filler is calcium carbonate, silica, alumina, titanium oxide, aluminosilicate, zeolite or fiberglass.
19. The substrate of claim 16, wherein the filler is an organic carbohydrate flour.
20. The substrate of claim 16, wherein the filler is carbon black.
21. The substrate of any one of claims 16 to 20, wherein the base layer comprises 5 to 85% by weight of the filler.
22. The substrate of any one of claims 1 to 21, wherein the base layer comprises pigments, colorants, or polymer processing additives, such as antioxidants and flowing agents.
23. The substrate of any one of claims 1 to 22, wherein the base layer is between about 50 and about 400 μm thick.
24. The substrate on any one of claims 1 to 23, wherein the base layer is made of a recyclable material.
25. The substrate of any one of claims 1 to 24, wherein the base layer has a density lower than the density of the processing liquid, said processing liquid having a density lower than the density of the aluminum layer.
26. The substrate of any one of claims 1 to 25, wherein the layer of first adhesive is between about 1 and about 100 μm thick.
27. The substrate of any one of claims 1 to 26, wherein the aluminum layer is between about 5 and about 150 μm thick.
28. The substrate of any one of claims 1 to 27 further comprising an aluminum oxide layer covering the aluminum layer.
29. The substrate of claim 28, wherein the aluminum oxide layer has a roughness between about 0.1 and about 1.0 μm.
30. The substrate of claim 28 or 29, wherein the aluminum oxide layer is between about 1 and about 5 μm thick.
31. The substrate of any one of claims 1 to 30 further comprising an outer layer covering the other side of the base layer.
32. The substrate of claim 31, wherein the outer layer comprises a thermoplastic resin.
33. The substrate of claim 32, wherein the thermoplastic resin is polyethylene, polypropylene, polymethylmethacrylate, polyethylene phthalate, polystyrene, polyvinyl chloride, a copolymer thereof or a mixture thereof.
34. The substrate of any one of claims 31 to 33, wherein the outer layer comprises a filler.
35. The substrate of claim 34, wherein the filler is as defined in any one of claims 17 to 20.
36. The substrate of any one of claims 31 to 35, wherein the outer layer comprises pigments, colorants, or polymer processing additives, such as antioxidants and flowing agents.
37. The substrate of any one of claims 31 to 36, wherein the outer layer is between about 1 and about 50 μm thick.
38. The substrate on any one of claims 31 to 37, wherein the outer layer is made of a recyclable material.
39. A method of manufacturing a lithographic printing plate substrate, the method comprising:
    (a) co-extruding a layer of a first adhesive with a base layer so that the layer of first adhesive covers one side of the base layer except for at least two opposite edges thereof, and
    (b) laminating an aluminum layer onto the layer of first adhesive and said opposite edges of the base layer, the aluminum layer thereby being sealed with the base layer at said opposite edges of the base layer.
40. The method of claim 39 further comprising in step (a), co-extruding strips of a second adhesive so that the strips of second adhesive cover said opposite edges of the base layer, and, in step (b), laminating the aluminum layer onto the layer of first adhesive and said strips of second adhesive.

41. The method of claim 39 or 40 further comprising in step (a), co-extruding an outer layer so that the outer layer covers the other side of the base layer.
42. A method of manufacturing a lithographic printing plate substrate, the method comprising:
    (a) extruding a base layer,
    (b) coating a layer of a first adhesive on an aluminum layer so that the layer of first adhesive covers one side of the aluminum layer except for at least two opposite edges thereof, and
    (c) laminating the aluminum layer onto the base layer so that the base layer covers the layer of first adhesive and said opposite edges of the aluminum layer, the aluminum layer thereby being sealed with the base layer at said opposite edges of the aluminum layer.
43. The method of claim 42, further comprising, before, during or after step (b), coating strips of a second adhesive onto the opposite edges of the aluminum layer, and wherein, in step (c), the aluminum layer is laminated so that it covers the layer of first adhesive and said strips of second adhesive.
44. The method of claim 42 or 43 further comprising in step (a), co-extruding an outer layer with the base layer so that the outer layer covers the other side of the base layer.
45. The method of any one of claims 39 to 44, further comprising forming an aluminum oxide layer on the aluminum layer.
46. The method of any one of claims 39 to 45 wherein the base layer, the layer of first adhesive, the aluminum layer, and, if present, the aluminum oxide layer, the strips of second adhesive and the outer layer are as defined in any one of claims 1 to 38.
47. A lithographic printing plate comprising the substrate of any one of claims 1 to 38 and an imaging layer coated on said substrate.
48. The printing plate of claim 47, wherein the imaging layer is positive working.
49. The printing plate of claim 47, wherein the imaging layer is negative working.
50. The printing plate of any one of claims 47 to 49, wherein an overcoat layer is coated on the imaging layer.
51. A method of processing a lithographic printing plate in view of recycling,
    the printing plate comprising a substrate comprising a base layer, a layer of first adhesive covering one side of the base layer except for at least two opposite edges thereof, and an aluminum layer laminated onto the layer of first adhesive and said opposite edges of the base layer, the aluminum layer thereby forming a seal with the base layer at said opposite edges of the base layer,
    wherein the first adhesive is soluble or dispersible in a processing liquid,
    the method comprising:
    (a) cutting the printing plate into flakes;
    (b) dispersing said flakes into the processing liquid, thereby dissolving or dispersing the layer of first adhesive in the processing liquid and de-laminating the aluminum layer from the base layer; and
    (c) separating the flakes of the base layer and/or the flakes of the aluminum layer from the processing liquid.
52. The method of claim 51, wherein, in the substrate, strips of a second adhesive cover said opposite edges of the base layer and wherein the aluminum layer is laminated onto the layer of first adhesive and said strips of second adhesive.
53. The method of claim 51 or 52, wherein the base layer has a density lower than the density of the processing liquid and wherein the processing liquid has a density lower than the density of the aluminum layer whereby in step (b), flakes of the base layer float at the surface of the processing liquid while flakes of the aluminum layer sink at the bottom of the processing liquid.
54. The method of any one of claims 51 to 53 further comprising the step drying the flakes of the base layer and/or the flakes of the aluminum layer.
55. The method of any one of claims 51 to 54 wherein the processing liquid is water or an alcohol-water mixture.
56. The method of any one of claims 51 to 55 further comprising recycling the flakes of the base layer and/or the flakes of the aluminum layer.
57. The method of any one of claims 51 to 56 wherein the base layer, the layer of first adhesive, the aluminum layer, the aluminum oxide layer and optionally the outer layer and the strips of second adhesive are as defined in any one of claims 1 to 38.

DETAILED DESCRIPTION OF THE INVENTION

Turning now to the invention in more details. There is provided in a first aspect of the invention, a lithographic printing plate substrate comprising (a) a base layer, (b) a layer of a first adhesive covering one side of the base layer except for at least two opposite edges thereof, and (c) an aluminum layer laminated onto the layer of first adhesive and said opposite edges of the base layer, the aluminum layer thereby being sealed with the base layer at said opposite edges of the base layer.

In embodiments, the substrate also comprises an aluminum oxide layer covering the aluminum layer. This layer can be produced by treating the aluminum layer as known in the art. Indeed, as stated above, aluminum substrates of the prior art are typically treated to form an aluminum oxide layer on their surfaces. Thus, the aluminum layer can be similarly treated to produce the aluminum oxide layer.

As one or more of the layers in this substrate (such as the base layer, the layer of first adhesive, as well as the optional outer layer discussed below) are typically made of plastic, such substrate will sometimes be referred to herein as an aluminum-laminated plastic (ALP) substrate. It is important to note however that materials other than plastic can be used in the substrate of the invention as described in more details below. In particular, in some embodiments, the base layer is made of paper.

The substrate of the invention can be used to produce lithographic printing plates, including lithographic offset printing plates, simply by coating it with the one or more layers necessary to produce and print an image as is known in the art. Typically, these layers will be coated on the aluminum oxide layer. If the substrate is provided without an aluminum oxide layer, this layer can be first produced as known in the art and/or as described below, then the one or more layers necessary to produce and print an image may be coated on the aluminum oxide layer. Alternatively, a hydrophilic layer, possibly a polymeric hydrophilic layer, can be coated on the aluminum layer and the one or more layers necessary to produce and print an image may be coated on this hydrophilic layer. Selecting and using such hydrophilic layers is well within the skills of the skilled person.

The substrate of the invention comprises multiple layers. When describing the substrate and more generally the invention herein, "comprising" means "including, but not limited to". Thus the substrate comprises the abovementioned layers, but may also comprise other layers. Also, the abovementioned layers may appear more than once in the substrate, for example there may be two layers of adhesive, etc. Finally, each of the abovementioned layers can itself be multilayered (i.e. composed of more than one layer).

Figure 1:
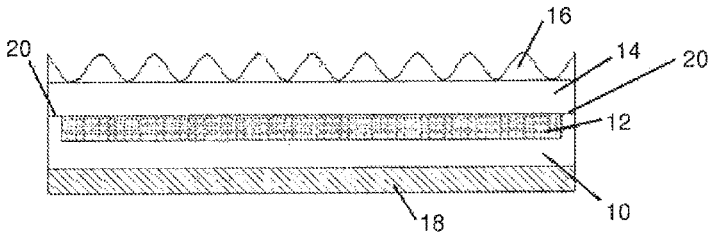
FIG. 1 is a cross-sectional scheme of an embodiment of the lithographic printing plate substrate according to the invention.

A crude scheme of an embodiment of the substrate of the invention can be seen in FIG. 1. The substrate in this figure comprises base layer (10), layer of first adhesive (12) on one side of base layer (10), aluminum layer (14) and optional aluminum oxide layer (16). Optional outer layer (18), which is on the other side of base layer (10), can also be seen in FIG. 1.

The seal (20) between the aluminum layer and base layer at the opposite edges of the base layer is also apparent in FIG. 1. This seal prevents the layer of first adhesive from contacting the ink and the fountain solution when the substrate (as part of a printing plate) is used on a printing press. This reduces risks of de-lamination of the substrate and therefore allows longer runs on press. To attain this goal, it is not necessary to have a seal on all (typically four) edges of the substrate because printing plates are generally mounted on printing press cylinders using clamps on two opposite sides of the printing plate. These clamps shield the edges of the substrate on these sides of the printing plate. Therefore, a seal is typically only desirable on the edges of the two sides of the printing plate that are not shielded by the clamps. This is advantageous as it allows producing the substrate of the invention continuously as a single roll. Nevertheless, it is also possible and contemplated by the present invention that the aluminum layer and the base layer form a seal along all edges of the substrate.

In embodiments, the substrate comprises strips of a second adhesive covering said opposite edges of the base layer. Furthermore, the aluminum layer is laminated onto the layer of first adhesive and the strips of second adhesive. Therefore, it can be said that the aluminum layer is sealed with the base layer through this second adhesive. The second adhesive is typically insoluble and non-dispersible in water and fountain solutions so as to reduce risks of de-lamination of the substrate and therefore allow longer runs on press. Strips of second adhesive are particularly useful when the base layer cannot by itself from a sufficient seal with the aluminum layer upon lamination. This may be the case when paper is used for the base layer.

In embodiments, the second adhesive is solvent-based. In other words, it is an adhesive prepared with a solvent that is not aqueous, for example an organic solvent. In embodiments, the second adhesive is an urethane adhesive.

Figure 2:
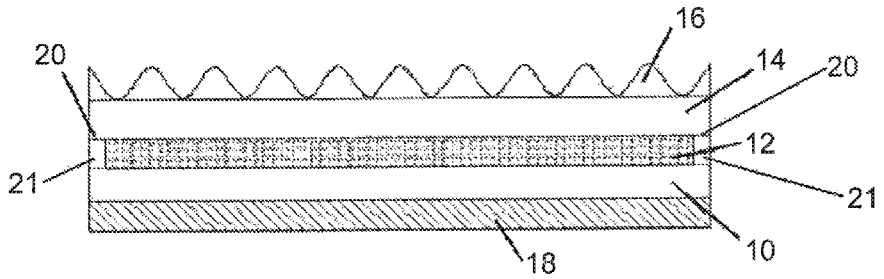
FIG. 2 is a cross-sectional scheme of an embodiment of the lithographic printing plate substrate according to the invention.

Strips of second adhesive (21) are shown in FIG. 2, where the remaining reference characters designate the same elements as in FIG. 1.

When taken together, all the layers of the substrate should provide enough structural strength for the substrate to be usable on printing presses. The substrate should be flexible, thick and strong enough to be manipulated and used on typical lithographic printing presses and other associated machines, such as plate-setters, and to maintain its structural integrity and shape. It should also be flexible enough to be readily installed on printing press cylinders (that have a curved surface necessitating the printing plate to bend to adopt the same curve).

The structural strength of the substrate is typically provided by the base layer and/or by the optional outer layer (if it is present). Other layers may also contribute to the structural strength of the substrate, such as the aluminum layer for example. However, increasing the thickness of the aluminum layer increases the cost of the substrate and thus it is preferred to keep this layer thin.

The exact nature of the base layer material is not crucial. The material is chosen based on cost and handling characteristics. It is sufficient that the base layer, together with the other layers, of the substrate, the base layer provides the desired structural strength.

In embodiments, the base layer is between about 50 and about 400 μm thick. Herein, all the thickness values are average values for the whole layer concerned.

In embodiments, the base layer can be a plastic layer, a composite layer, a cellulose-based layer such as cardstock or paper, or a non-woven fabric layer. The skilled person will easily determine if the use of strips of the second adhesive is warranted based on the exact nature of the base layer and it capacity at forming a seal with the aluminum layer upon lamination.

In embodiments, when the base layer is a plastic layer, it can be a solid plastic layer, a multi-laminate layer, or a plastic foam layer. Of course, such foam would be sufficiently dense so as to contribute to the structural strength of the substrate.

In embodiments, the base layer comprises a thermoplastic resin, such as a petroleum based thermoplastic resin or a biomass based thermoplastic resin. Example of such resins include polystyrene (PS), polyethylene (PE), polypropylene (PP), polyester (PET), polyamide (PA), polyvinyl chloride (PVC), polyetheretherketone (PEEK), polyimide (PI), polyvinylacetate (PVA), polyalkylacrylate (PAAA), polyalkylmethacrylate (PAMA), polylactide, polybutahydroburate, polysuccinamate, cellulosic polymers, copolymers thereof, and mixtures thereof.

These thermoplastic resins, and any plastic used as a base layer, may comprise one or more fillers. These fillers may play different roles as needed: they can make the base layer harder, they can make the base layer rougher and/or they can lower the density of the base layer. Making the base layer harder contributes to the structural strength of the substrate. Making the base layer rougher reduces the stickiness of printing plates with each other, which allows staking them for storage or use without using interleaving paper. This also eliminate the need for interleaving paper when cutting the printing plates to size. Making the base layer less dense lowers the weight of the substrate and eases its recycling as explained below.

In embodiments, the amount of fillers in the resins is between about 5 to about 85% by weight.

The filler may be an inorganic filler, such as, for example, calcium carbonate, silica, alumina, titanium oxide, aluminosilicate, zeolite and fiberglass.

The filler may also be an organic carbohydrate flour, such as that obtained from biomass and natural fibers, such as starch, sawdust, rice husks, rice straw, wheat straw, and sugarcane bagasse.

The filler may also be carbon black or another similar material.

In embodiments, the base layer may further comprise pigments or colorants. These allow, for example, identifying a given product or a given brand. The base layer may also comprise polymer processing additives, such as antioxidants and flowing agents for example.

In embodiments, the base layer is produced by melt extrusion, possibly with one or more of the other layers of the substrate as explained below.

In the interest of making the substrate of the invention recyclable, in embodiments, the base layer is made of a recyclable material. In specific embodiments, the base layer has a density lower than the density of a processing liquid, which is typically water or a water-based solution (such as an alcohol-water mixture) as described below, the processing liquid itself having a density lower than the density of the aluminum layer, which is also recyclable. This helps separating the different substrate layers during recycling (see below).

The layer of first adhesive provides for the adhesion of the aluminum layer to the rest of the substrate during processing and use. As such, the exact nature of the layer of first adhesive is not critical.

In embodiments, the layer of first adhesive is between about 1 and about 100 μm thick.

In embodiment, the layer of first adhesive is a plastic layer. In embodiments, the layer of first adhesive comprises a thermoplastic resin, preferably one that is soluble or dispersible in a processing liquid. Again, this is in the interest of making the substrate of the invention recyclable as this helps separating the substrate layers during recycling as explained below.

The layer of first adhesive may be produced by melt extrusion (possibly by co-extrusion with one or more of the other layers of the substrate as explained below). In this case, the thermoplastic resins may be, for example, linear polyvinyl alcohols, branched polyvinyl alcohols (for example that described in US2009/0286909, which is incorporated herein by reference), polyethylene oxide (such as that available under tradenames POLYOX™ from Dow Industrial Specialty Polymers and that available from Sumitomo Seika, Japan), polyamides (such as that described in U.S. Pat. No. 5,324,812 and U.S. Pat. No. 6,103,809), water soluble polyesters (such as that available under tradename Zypol from Zydex Industries, India), acrylic acid copolymers, and methacrylic acid copolymers.

Alternatively, the layer of first adhesive may be produced by coating (for example the aluminum layer)s with a polymeric solution following by drying (for example in an oven using hot air or near infrared heating tubes). In that case, the polymeric solution may be an homogeneous solution or an emulsion of, for example, a polyvinyl alcohol, polyethylene oxide, an acrylic acid copolymer, a methacrylic acid copolymer, an urethane polymer, an urea polymer, an amide polymer, an ester polymer, copolymers thereof or a mixture thereof.

The aluminum layer comprises aluminum and, in embodiments, is between about 5 and about 150 μm thick.

The aluminum oxide layer, when present, comprises aluminum oxide and, in embodiments, has a roughness between about 0.1 and about 1.0 μm. In embodiments, this layer is between about 1 and about 5 μm thick.

The aluminum oxide layer is hydrophilic and thus provides a base for the coating of an imaging layer. This layer may be prepared on top of the aluminum layer by electrolytic processes known to the skilled person. Also, the hydrophilicity of the aluminum oxide layer may be enhanced by processes known to the skilled person. For example, the aluminum oxide layer may be treated with organic and inorganic hydrophilic agents. The organic hydrophilic agents may be, for example, water-soluble polymers, copolymers, dendrimers or oligomers comprising phosphoric acid, carboxylic acid, sulfonic acid, or sulfuric acid functional groups. The inorganic hydrophilic agents may be, for example, aqueous solutions of sodium silicate, potassium silicates, and mixture of sodium dihydrophosphate and sodium fluoride.

In embodiments, the substrate further comprises an outer layer covering the other side of the base layer (i.e. the side not covered by the layer of first adhesive and mounted on and facing the lithographic press cylinder). This layer may be between about 1 and about 50 μm thick. This layer may be a plastic layer. In embodiments, the outer layer comprises a thermoplastic resin. In embodiments, the thermoplastic resin is polyethylene, polypropylene, polymethylmethacrylate, polyethylene phthalate, polystyrene, polyvinyl chloride, a copolymer thereof or a mixture thereof.

In embodiments, the outer layer is produced by melt extrusion, possibly with one or more of the other layers of the substrate as explained below.

Like the base layer, the outer layer may comprise, in embodiments, pigments, colorants, fillers (such as that described above for the base layer), and/or polymer processing additives such as antioxidants and flowing agents.

The above substrate in its different embodiments is suitable for the manufacturing of lithographic printing plates. These printing plates may have several advantages, such as a reduced cost of production compared to using plain aluminum substrates (because there is less aluminum in the substrate of the invention). Another advantage is typically long runs on press as illustrated by the examples below. When using an appropriate base layer, such as a plastic or paper, and/or an optional outer layer, another advantage is that no interleaving paper is needed for packaging as described above. This also significantly decreases handling costs, especially when the substrates or printing plates are cut to size and when they are used. Finally, many embodiments of the printing plates are recyclable.

In another aspect, the present invention provides methods of manufacturing a lithographic printing plate substrate.

In a first embodiment, the method comprises (a) co-extruding a layer of a first adhesive with a base layer so that the layer of first adhesive covers one side of the base layer except for at least two opposite edges thereof, and (b) laminating an aluminum layer onto the layer of first adhesive and said opposite edges of the base layer, the aluminum layer thereby being sealed with the base layer at said opposite edges of the base layer.

In more specific embodiments, the method further comprises in step (a), co-extruding strips of a second adhesive so that the strips of second adhesive cover said opposite edges of the base layer, and, in step (b), laminating the aluminum layer onto the layer of first adhesive and said strips of second adhesive.

When an outer layer is present, it may be co-extruded in step (a) (i.e. together with the base layer and the layer of first adhesive) so that the outer layer covers the other side of the base layer (i.e. the side opposite the layer of first adhesive).

In an alternative embodiment, the method comprises (a) extruding a base layer, (b) coating a layer of a first adhesive on an aluminum layer so that the layer of first adhesive covers one side of the aluminum layer except for at least two opposite edges thereof, and (c) laminating the aluminum layer onto the base layer so that the base layer covers the layer of first adhesive and said opposite edges of the aluminum layer, the aluminum layer thereby being sealed with the base layer at said opposite edges of the aluminum layer.

In more specific embodiments, the method further comprises, before, during or after step (b), coating strips of a second adhesive onto the opposite edges of the aluminum layer, and wherein, in step (c), the aluminum layer is laminated so that it covers the layer of first adhesive and said strips of second adhesive.

When an outer layer is present, it may be co-extruded in step (a) with the base layer prior to lamination with the aluminum layer coated with the layer of first adhesive.

Both these embodiments may also further comprise the step of forming an aluminum oxide layer on the aluminum layer.

In these embodiments of the method, the substrate, the base layer, the layer of first adhesive, the aluminum layer, the aluminum oxide layer and the optional outer layer and strips of second adhesive are as defined in respect of the first aspect of the invention.

Figure 3:
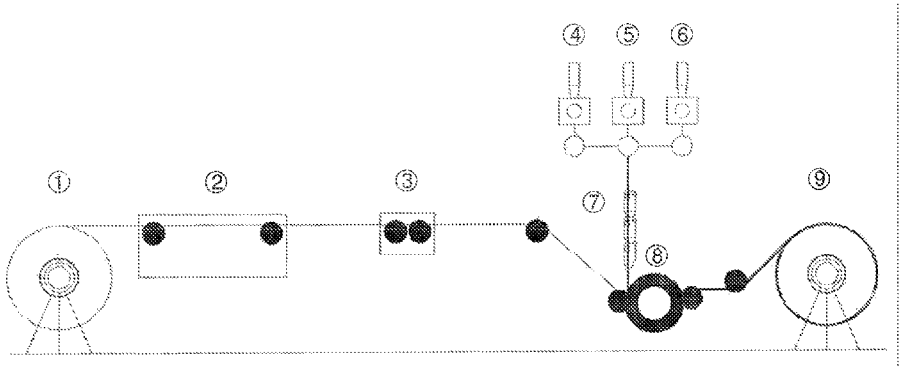
FIG. 3 is a scheme of an apparatus for manufacturing a lithographic printing plate substrate according to the invention.
Figure 4:
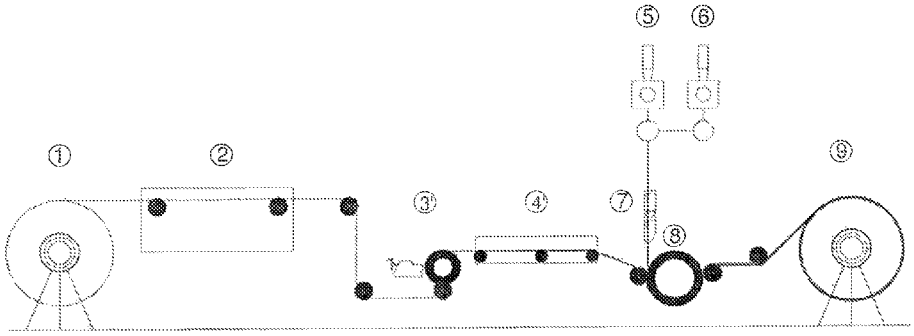
FIG. 4 is a scheme of an apparatus for manufacturing a lithographic printing plate substrate according to the invention.

A description of a specific embodiment of the above methods now follows with reference to FIGS. 3 and 4.

An aluminum coil is first unwound using unwind system (1).

The aluminum surface is degreased by washing with an aqueous alkaline solution containing sodium hydroxide (3.85 g/l) and sodium gluconate (0.95 g/l) at around 65° C. to remove the organic oils and creases on the aluminum surface. The solution is neutralized with an aqueous hydrochloric acid solution (2.0 g/l) and then washed away with water. Subsequently, the aluminum is dried in an oven with hot air or infrared heating tubes. This step is carried out in surface treatment unit (2). Alternatively, the aluminum may be degreased by burning off oils and greases on the surface. This can be achieved using, for example, a flame (from e.g. natural gas), electrical heaters and the like.

The aluminum is corona or plasma treated in the corona or plasma treatment unit (3) to enhance adhesion to the layer of first adhesive.

The base layer, the layer of first adhesive and optionally the outer layer are co-extruded together using extruders (4), (5) and (6) to produce a multilayered substrate base which is formed onto a multilayered sheet in sheet forming section (7) as seen on FIG. 3.

Alternatively, as seen on FIG. 4, the base layer and optionally the outer layer are co-extruded together using extruders (5) and (6) to produce a multilayered substrate base which is formed onto a multilayered sheet in sheet forming section (7). The layer of first adhesive is coated from a polymeric solution onto the aluminum in coating section (3'). The coated aluminum is then dried in an oven (4') using hot air or near infrared heating tubes.

In both cases, the multilayered sheet is then laminated onto the aluminum in laminating unit (8) to produce a laminated substrate.

Optionally, the laminated substrate is rewound to form a coil (9). Alternatively, the laminated substrate can be directly subjected to an electrolytic process to form the aluminum oxide layer. This electrolytic process can be carried out on a continuous production line with a web process or sheet-fed process. For example, this electrolytic process may comprise the following steps:

- Washing with aqueous alkaline solution containing sodium hydroxide (3.85 g/l) and sodium gluconate (0.95 g/l) at 65° C. to remove the organic oil and crease on the surface of aluminum layer;
- Neutralizing with aqueous hydrochloric acid (2.0 g/l);
- Washing with water to remove the hydrochloric acid solution excess;
- Electrolytic graining in aqueous electrolyte containing an aqueous solution of hydrochloric acid (8.0 g/l) and acetic acid (16 g/l) using a carbon electrode at 25° C. The current and charge density may be 38.0 A/dm$^2$ and 70.0 C/dm$^2$, respectively;
- Desmuting with an aqueous sodium hydroxide solution (2.5 g/l);
- Neutralizing with an aqueous sulfuric acid solution (2 g/l);
- Washing with water to remove the excess acid;
- Anodizing in an aqueous electrolyte containing sulfuric acid (140 g/l) at 25° C.; the current and charge density being adjusted to produce an aluminum oxide layer having a thickness between 2.5 and 3.0 g/m$^2$;
- Washing with water;
- Treating with aqueous solution containing sodium dihydrophosphate (50 g/l) and sodium fluoride (0.8 g/l) at 75° C. to enhance the hydrophilicity of the surface;
- Washing with water at 50° C.; and
- Drying with hot air at 110° C.

Then, the substrate may be rewound into coils or alternatively, it can be directly coated with an imaging layer to form a lithographic printing plate as described below.

In another aspect of the invention, there is provided a lithographic printing plate comprising the above described substrate and an imaging layer coated on the substrate (typically on the aluminum oxide layer). Generally, any suitable under-layers, imaging layers, overcoat layers and the like known the person skilled in the art of producing lithographic printing plates may be used with the substrates of the invention.

An imaging layer is a layer that is sensitive to radiation (typically a laser) and allows recording, developing and printing an image with the printing plate. In embodiments, the imaging layer is positive working. In other embodiments, the imaging layer is negative working. Any imaging layer known to the skilled person to be useful for the producing of lithographic printing plate may be used with in the lithographic printing plates of the invention.

More specifically, the imaging layer may be an imaging layer for positive working lithographic printing plates of this invention as taught in U.S. Pat. No. 6,124,425; U.S. Pat. No. 6,177,182 and U.S. Pat. No. 7,473,515, which are incorporated herein by reference. Also, the imaging layer may be an imaging layer for negative working lithographic printing plates as taught in US 2007/0269739; US 2008/0171286; US 2010/0035183 and US 2010/0062370, which are also incorporated herein by reference.

Figure 5:
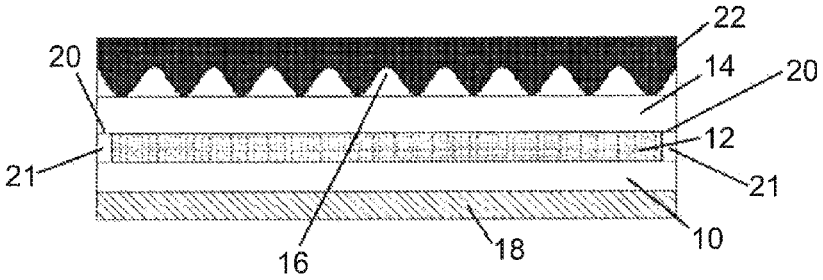
FIG. 5 is a cross-sectional scheme of an embodiment of the lithographic printing plate according to the invention.
Figure 6:
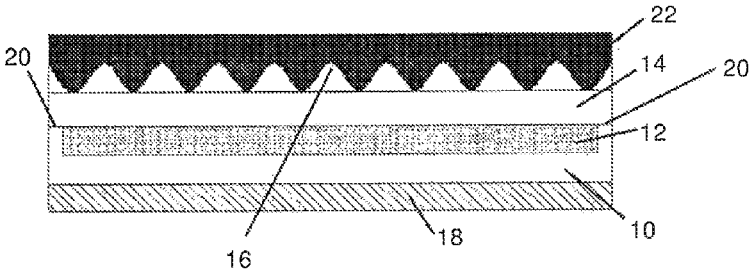
FIG. 6 is a cross-sectional scheme of an embodiment of the lithographic printing plate according to the invention.

In embodiments, the lithographic printing plate of the invention may comprise a single imaging layer (22) as shown in FIGS. 5 and 6. In this figure, the other reference characters designate the same elements as in FIGS. 1 and 2.

Figure 7:
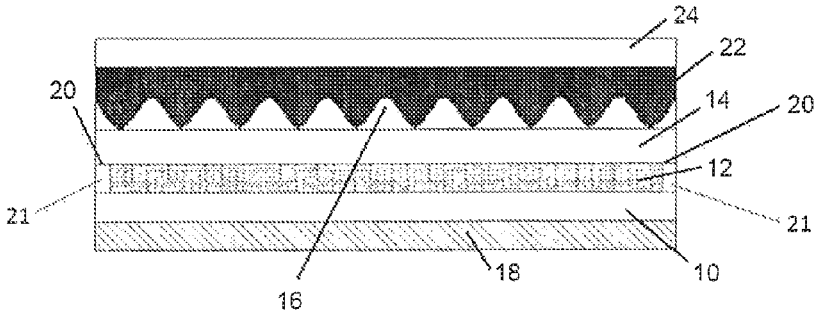
FIG. 7 is a cross-sectional scheme of another embodiment of the lithographic printing plate according to the invention.
Figure 8:
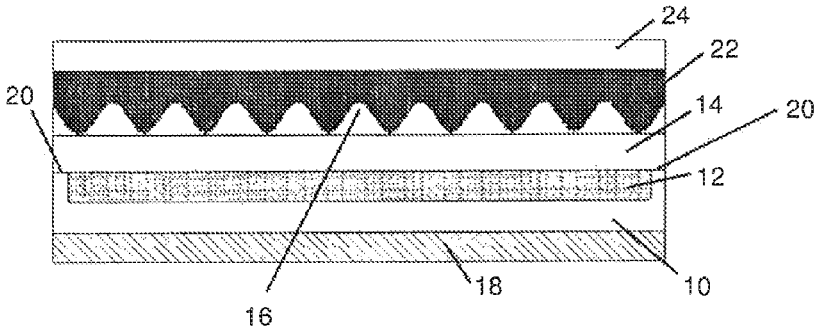
FIG. 8 is a cross-sectional scheme of another embodiment of the lithographic printing plate according to the invention.

In further embodiments, the imaging layer may be coated with an overcoat layer. This layer is identified by reference character 24 in FIGS. 7 and 8, while the other reference characters designate the same elements as in FIGS. 1, 2, 5 and 6. Suitable overcoat layers are known to the skilled person. These may have different roles such as protecting the imaging layer from ambient light or humidity, reducing the stickiness of the printing plate, etc. In embodiments, the overcoat layer may also be sensitive to laser light as is the imaging layer. Generally, this enhances imaging and/or developing speeds.

Depending on the imaging layer used (and optionally the overcoat layer if it is sensitive to laser light), the lithographic printing plate of the invention may be imaged with near infrared laser radiation having a wavelength between 780 and 1,100 nm or ultraviolet laser radiation having a wavelength between 350 and 450 nm.

In a last aspect of the present invention, there is provided a method of processing a lithographic printing plate in view of recycling, the printing plate comprising a substrate comprising a base layer, a layer of first adhesive covering one side of the base layer except for at least two opposite edges thereof, and an aluminum layer laminated onto the layer of first adhesive and said opposite edges of the base layer, the aluminum layer thereby forming a seal with the base layer at said opposite edges of the base layer, wherein the first adhesive is soluble or dispersible in a processing liquid, the method comprising (a) cutting the printing plate into flakes; (b) dispersing said flakes into the processing liquid, thereby dissolving or dispersing the layer of first adhesive in the processing liquid and de-laminating the aluminum layer from the base layer; and (c) separating flakes of the base layer and/or flakes of the aluminum layer from the processing liquid.

In embodiments, in the substrate, strips of a second adhesive cover said opposite edges of the base layer and wherein the aluminum layer is laminated onto the layer of first adhesive and said strips of second adhesive.

This is a method for processing (typically spent) lithographic printing plates in view of recycling. This method allows separating the aluminum-based part (comprising the aluminum layer and, if applicable, the aluminum oxide layer, the imaging layer, the overcoat layer and any other layer coating the substrate) of the printing plate from the base part (comprising the base layer together with the outer layer if applicable) of the printing plate and thus to recycle each of these parts according to its nature. Therefore, the aluminum part can be recycled as scrap metal and the base part can be recycled as appropriate according to its exact nature.

In step (a), the spent printing plate is cut into flakes. The size of the flakes is not particularly important as long as they are small enough to provide the processing liquid sufficient access to the layer of first adhesive (along the cut sides of the flakes) and thus cause solubilization or dispersion of the layer of first adhesive and the de-lamination of the aluminum layer from the base layer. The cutting can be carried out by any suitable mechanical means known to the skilled person. For example, the substrate or the printing plate may be shredded using a shredder and/or a grinder.

In step (b), the flakes are dispersed into the processing liquid. Since the cut sides of the flakes allows this liquid to access the layer of first adhesive and since the layer of first adhesive is soluble or dispersible in the processing liquid, this will lead to the dissolution or dispersion of the layer of first adhesive and to the de-lamination of the aluminum layer from the base layer. As a result, flakes of the base layer and flakes of the aluminum layer in the processing liquid are obtained. At this step, mechanical means, such as for example stirring, and/or heating can be used to help disperse the flakes in the processing liquid and/or to enhance the rate of dissolution/dispersion of the layer of first adhesive in the processing liquid.

Herein, "flakes of the aluminum layer" means flakes of the aluminum part of the substrate as described above, i.e. flakes comprising the aluminum layer and, if applicable, the aluminum oxide layer, the imaging layer, the overcoat layer and any other layer coating the substrate. Similarly, "flakes of the base layer" means flakes of the base part of the substrate as described above, i.e. flakes comprising the base layer together with the outer layer if applicable.

The next step of the method comprises the separation of the flakes of the base layer and/or the flakes of the aluminum layer from the processing liquid. This allows proceeding further with the recycling of the flakes thus separated from the processing liquid.

In a more specific embodiment, the flakes of the base layer have a density lower than the density of the processing liquid and the processing liquid has a density lower than the density of the flakes of the aluminum layer whereby in step (b), flakes of the base layer float at the surface of the processing liquid while flakes of the aluminum layer sink at the bottom of the processing liquid. For note, the density of aluminum itself is about 2.71 g/mL and that of water is 1 mg/mL. In this specific embodiment, the separation of the flakes of the base layer and the flakes of the aluminum layer from the processing liquid is easier. For example, the flakes of the base layer that tend to float on the processing liquid can be separated by overflowing the vessel containing the flakes and the processing liquid with more processing liquid, thereby causing the flakes of the base layer to spill over the vessel. A net or another suitable means can then be used to catch the flakes of the base layer. The flakes of the base layer may also be collected, for instance, by a skimmer. Also, the flakes of the aluminum layer can be separated from the processing liquid by decantation, filtration or another similar means.

It should be noted that, in this embodiment, while it is preferred that all of the flakes of the base layer float and all of the flakes of the aluminum layer sink, it is possible and contemplated in the present invention, that only some or only most of the flakes do so.

In embodiments, the method further comprises the step of drying the flakes of the base layer and/or the flakes of the aluminum layer. This eases handling of the flakes and their further recycling.

In embodiments, the processing liquid is water or an alcohol-water mixture. It is to be noted that the exact nature of the processing liquid is not critical as long as it dissolves or disperses the layer of first adhesive. In more specific embodiments, the processing liquid has a density between that of the flakes of the base layer and that of the flakes of the aluminum layer to allow the flakes of the base layer to float and the flakes of the aluminum layer to sink. Water is a suitable processing liquid as it is cheap, plentiful and non-toxic. Adding alcohol to the water, thus forming an alcohol-water mixture, modifies the density of the liquid and allows better control over the flotation and sinking of the different flakes and may help dissolving or dispersing the layer of first adhesive. Also, many alcohols are non-toxic and/or common and/or easy to handle, which makes them very much suitable for use in large quantities.

In embodiments, the method further comprises recycling the flakes of the base layer and/or the flakes of the aluminum layer.

In this method, the substrate, the base layer, the layer of first adhesive, the aluminum layer, and optionally the aluminum oxide layer, the strips of second adhesive and the outer layer are as defined in respect of the first aspect of the invention as long as the layer of first adhesive is soluble or dispersible in a processing liquid.

Herein, "about" followed by a numerical value means this numerical value plus or minus 5%.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

The present invention is illustrated in further details by the following non-limiting examples.

GLOSSARY

| | |
|---|---|
| $CaCO_3$ | Calcium carbonate |
| Ethanox 330 | Antioxidant, available from Albermarle Corporation, Baton Rouge, Louisiana, USA |
| VS151 black ink | Rubber Base Plus ®, VS151 Black #10850, oil base black ink, available from Royal Dutch Printing Ink Factory Van Son, Holland. |
| FS100 | Fountain solution, available from Mylan Group, Travinh, Vietnam. |
| FX5911X | Dynamar ™ Polymer Processing Additive, available from Dyneon LLC, Oakdale, Minnesota, USA. |
| ExxonMobil ™ PP1042 | Polypropylene homopolymer, available from Exxon Mobil, USA. |
| CP-1210T30 | Thermoplastic polyvinyl alcohol, available under trade name CP-polymers from Kuraray America Inc., Houston, Texas, USA. |
| PEG400 | Poly(ethylene glycol) monolaurate having Mn around 400, available from Sigma Aldrich, Canada. |
| Thermolak ® 7525 | Phenolic resin, available from American Dye Source, Baie d'Urfe, Quebec, Canada. |
| Thermolak ® 1020 | Near-infrared absorbing phenolic resin, available from American Dye Source, Baie d'Urfe, Quebec, Canada. |
| CAP | Cellulose acetate phthalate, available under trade name Eastman C-A-P Cellulose Ester NF from Eastman, Kingsport, Tennessee, USA. |
| Basic Violet 3 | Visible colorant, available from Spectra Colors, Kearny, New Jersey, USA. |
| P1000S Surfactant | Polysiloxane modified with poly(ethylene oxide) pendant group, available from American Dye Source, Baie d'Urfe, Quebec, Canada. |
| Dowanol PM | 2-methoxy propanol, available from Dow Chemicals, Ho Chi Minh City, Vietnam. |
| MEK | Methyl ethyl ketone, available from Sapa Industries, Ho Chi Minh City, Vietnam. |
| WG100 | Gum solution, available from Agfa, Belgium. |

Example 1

Preparation of an Aluminum-Laminated-Plastic Substrate

Aluminum foil with a thickness around 50 μm was degreased, dried in an oven using hot air. It was plasma treated to enhance adhesion and then fed into a laminating roller.

The layer of adhesive (thickness around 15 μm) had the following composition:

| | |
|---|---|
| CP-1210T30 | 93 parts |
| PEG400 | 5 parts |
| Ethanox 330 | 2 parts |

The base layer (thickness around 150 μm) had the following composition:

| | |
|---|---|
| ExxonMobil ™ PP1042 | 67.98 parts |
| FX5911X | 0.02 parts |
| Ethanox 330 | 2.00 parts |
| Calcium carbonate | 30.00 parts |

The outer layer (thickness around 60 μm) had the following composition:

| | |
|---|---|
| ExxonMobil ™ PP1042 | 97.98 parts |
| FX5911X | 0.02 parts |
| Ethanox 330 | 2.00 parts |

These layers were co-extruded using a T-die at a temperature between 210 and 260° C. using a counter rotation bi-screw Reifenhauser extruder at a speed of 40 RPM. The three-layer film thus obtained was laminated with aluminum foil using the laminating roller. This laminated product was then chilled at 45° C. on a chiller roll. A uniform aluminum-laminated-plastic film with good adhesion was obtained.

The aluminum-laminated-plastic film then underwent an electrolytic process to produce a hydrophilic aluminum oxide layer on the surface of the aluminum. The surface roughness of this substrate was 0.48 μm and its oxide weight around 2.8 $g/m^2$. The ALP substrate thus produced was ready for coating with a laser sensitive coating.

Example 2

Positive Working Thermal Lithographic Offset Printing Plate

The ALP substrate of Example 1 was coated with a laser sensitive polymeric solution having the following composition:

| Constituents | Weight (Kg) |
|---|---|
| Thermolak ® 7525 | 8.15 |
| Thermolak ® 1020 | 1.00 |
| CAP | 0.20 |
| Basic Violet 3 | 0.25 |
| P1000S | 0.40 |
| Dowanol PM | 75.0 |
| Methyl ethyl ketone | 15.0 |

The coating solution was filtered through a 0.5 μm filter and then coated using a slot-die coating head. The coated web was then dried at 110° C. using hot air to give a coating weight of 1.7 $g/m^2$. The printing plate was cut to sheet and then stored at room conditions.

After one week storage, the plate was imaged with a plate-setter (PlateRite 8600S, available from Screen, Japan) at an energy density 150 mJ/cm$^2$. The imaged plate was developed with GSP85 developer (available from Mylan Group, Travinh, Vietnam) at 24° C. and with 20 seconds dwell time using a Tung Sung 88 processor (available from Tung Sung, Malaysia). A clean and high resolution image with 1 to 99% dots was obtained after development. The developed plate was placed on a Heidelberg Quick Master 46 press using VS151 black ink and FS100 fountain solution (available from Mylan Group, Vietnam). The plate produced more than 80,000 copies without noticeable deterioration or reduced resolution of the printed image on the printed sheets.

Example 3

Negative Working Thermal Lithographic Offset Printing Plate

The substrate of Example 1 was coated with a laser sensitive polymeric solution prepared according to Example 12 of patent publication US2008/0171286, which is incorporated herein by reference, using a wire-wound rod. The coated plate was dried using hot air at 80° C. to obtain a coating weight of 1.0 g/m$^2$. The plate was imaged at 185 mJ/cm$^2$. The imaged plate was hand-developed with a WG100 gum solution to give a clean and high resolution image with 1 to 99% dots. The developed plate was placed on Heidelberg Quick Master 46 press using VS151 black ink and FS100 fountain solution (available from Mylan Group, Vietnam). The plate produced more than 30,000 copies without noticeable deterioration or reduced resolution of the printed image.

Example 4

Negative Working Thermal Lithographic Offset Printing Plate with Overcoat

The substrate of Example 1 was coated with laser sensitive polymeric solutions prepared according to Examples 6 to 12 of patent publication US2009/0035694, which is incorporated herein by reference, using a wire-wound rod. The coated plate was dried using hot air at 80° C. to obtain a coating weight of 1.0 g/m$^2$. An aqueous polymeric solution was coated over this laser sensitive layer using a wire-wound and dried using a hot air gun to obtain a coating weight around 0.6 g/m$^2$.

The plate was imaged at 185 mJ/cm$^2$. The imaged plate was hand-developed with a SP200 developer to give a clean and high resolution image with 1 to 99% dots. The developed plate was placed on a Heidelberg Quick Master 46 press using VS151 black ink and FS100 fountain solution (available from Mylan Group, Vietnam). The plate produced more than 30,000 copies without noticeable deterioration or reduced resolution of the printed image.

Example 5

Recycling of the Spent Lithographic Printing Plates

About 10 kg of used lithographic printing plates were shredded to form small flakes having an average area around 1.4 cm$^2$. The flakes were dispersed in 50 kg of water and stirred with a mechanical stirrer. After about 24 hours, aluminum flakes had separated themselves from the plastic flakes. Stirring was stopped. The aluminum flakes sank to the bottom of the water tank, while the plastic flakes floated on the surface of the water. Water was then slowly added into the water tank. The excess water overflew from the water tank carrying the plastic flakes with it. The plastic flakes were collected using a metal net. The aluminum flakes were collected by decanting the water tank. They were then air-dried and so were ready for recycling.

Although the present invention has been described hereinabove by way of specific embodiments thereof, it can be modified, without departing from the spirit and nature of the subject invention as defined in the appended claims.

REFERENCES

The present description refers to a number of documents, the content of which are herein incorporated by reference in their entirety:

U.S. Pat. No. 5,324,812;
U.S. Pat. No. 6,103,809;
U.S. Pat. No. 6,124,425;
U.S. Pat. No. 6,177,182;
U.S. Pat. No. 6,261,740;
U.S. Pat. No. 7,214,468;
U.S. Pat. No. 7,473,515;
US 2007/0269739;
US 2008/0171286;
US2009/0035694;
US 2009/0286909;
US 2010/0035183; and
US 2010/0062370.

The invention claimed is:

1. A lithographic printing plate substrate comprising:
a base layer,
a layer of a first adhesive covering one side of the base layer except for at least two opposite edges thereof, and
an aluminum layer laminated onto the layer of first adhesive and said opposite edges of the base layer, the aluminum layer thereby being in direct contact with and sealed with the base layer at said opposite edges of the base layer,
which thereby prevent the layer of first adhesive from contacting inks and fountain solutions when the substrate is used on a printing press and reduces the risks of de-lamination of the substrate.

2. The substrate of claim 1, wherein the first adhesive is soluble or dispersible in a processing liquid.

3. The substrate of claim 2, wherein the first adhesive is a thermoplastic resin.

4. The substrate of claim 2, wherein the base layer is made of a recyclable material.

5. The substrate of claim 4, wherein the base layer has a density lower than the density of the processing liquid, said processing liquid having a density lower than the density of the aluminum layer.

6. The substrate of claim 2, wherein said processing liquid is selected from the group consisting of water and water-alcohol mixtures.

7. The substrate of claim 1, wherein the base layer is a cellulose-based layer.

8. The substrate of claim 7, wherein said cellulose-based layer is paper.

9. The substrate of claim 1, wherein the base layer is a plastic layer.

10. The substrate of claim 9, wherein the plastic layer is a solid plastic layer.

11. The substrate of claim 9, wherein the plastic layer is a plastic foam layer.

12. The substrate of claim 9, wherein the base layer comprises a thermoplastic resin.

13. The substrate of claim 9, wherein the base layer comprises a filler.

14. The substrate of claim 1 further comprising an aluminum oxide layer covering the aluminum layer.

15. The substrate of claim 1 further comprising an outer layer covering the other side of the base layer.

16. The substrate of claim 15, wherein the outer layer comprises a thermoplastic resin.

17. The substrate of claim 15, wherein the outer layer comprises a filler.

18. The substrate of claim 15, wherein the outer layer is made of a recyclable material.

19. The substrate of claim 1 being comprised, together with a positive-working or negative-working imaging layer coated thereon, in a lithographic printing plate.

20. A method of processing a lithographic printing plate in view of recycling, the printing plate comprising a substrate according to claim 1, wherein the first adhesive is soluble or dispersible in a processing liquid, the method comprising:

(a) cutting the printing plate into flakes;

(b) dispersing said flakes into the processing liquid, thereby dissolving or dispersing the layer of first adhesive in the processing liquid and de-laminating the aluminum layer from the base layer; and (c) separating the flakes of the base layer and/or the flakes of the aluminum layer from the processing liquid.

21. The method of claim 20, wherein the base layer has a density lower than the density of the processing liquid and wherein the processing liquid has a density lower than the density of the aluminum layer whereby in step (b), flakes of the base layer float at the surface of the processing liquid while flakes of the aluminum layer sink at the bottom of the processing liquid.

22. The method of claim 20, wherein the processing liquid is water or an alcohol-water mixture.

23. A device for lithographic printing comprising:

a plate having a base layer having a first side and a second side, a layer of a first adhesive affixed to and covering said first side to define an area of first adhesive and at least two opposite edges which are free of first adhesive, and an aluminum layer laminated onto the layer of first adhesive and said opposite edges of the base layer, the aluminum layer thereby being in direct contact with and sealed with the base layer at said opposite edges of the base layer to form a plate substrate for lithographic plating.

* * * * *